US007699118B2

(12) United States Patent
Setter et al.

(10) Patent No.: US 7,699,118 B2
(45) Date of Patent: Apr. 20, 2010

(54) SYSTEM AND METHOD FOR CONTROLLING AN IMPACT TOOL

(75) Inventors: William Setter, Hartland, MI (US); Venkata Ramana Srinivasa Hogirala, Mount Prospect, IL (US)

(73) Assignee: Abas, Inc., Chicago, IL (US)

( * ) Notice: Subject to any disclaimer, the term of this patent is extended or adjusted under 35 U.S.C. 154(b) by 720 days.

(21) Appl. No.: 10/767,190

(22) Filed: Jan. 30, 2004
(Under 37 CFR 1.47)

(65) Prior Publication Data

US 2005/0167130 A1 Aug. 4, 2005

(51) Int. Cl.
*B25B 23/14* (2006.01)

(52) U.S. Cl. ..... 173/1; 173/176

(58) Field of Classification Search ..... 173/1, 173/93, 93.5, 93.6, 180, 181, 176, 182, 183, 173/93.7; 81/467, 470, 457
See application file for complete search history.

(56) References Cited

U.S. PATENT DOCUMENTS

| | | | | |
|---|---|---|---|---|
| 4,106,570 | A * | 8/1978 | Eshghy et al. | 173/183 |
| 4,669,319 | A * | 6/1987 | Heyraud | 73/862.23 |
| 5,366,026 | A | 11/1994 | Maruyama et al. | |
| 5,715,894 | A | 2/1998 | Maruyama et al. | |
| 6,311,786 | B1 | 11/2001 | Giardino et al. | |
| 6,655,471 | B2 | 12/2003 | Cripe et al. | |

* cited by examiner

*Primary Examiner*—Rinaldi I. Rada
*Assistant Examiner*—Nathaniel Chukwurah
(74) *Attorney, Agent, or Firm*—Blank Rome LLP

(57) ABSTRACT

A system and method for determining the actual torque being applied by an impact tool to a shaft of a fastener is disclosed, wherein an equation having a set of parameters that represent the time-amplitude curve of the individual pulses produced by the impact tool are used to correlate the impact tool pulses and the residual torque in the fastener without requiring knowledge of the torque of the fastener joint.

26 Claims, 7 Drawing Sheets

SYSTEM AND METHOD FOR CONTROLLING AN IMPACT TOOL

BACKGROUND OF THE INVENTION

1. Field of the Invention

The invention relates to control of the torque being applied to a body by an impact or impulse tool. More specifically, the invention is a method and apparatus that determines a best mathematical expression for representing individual pulses generated by an impact tool and solving the expression to accurately control the torque being applied to a body.

2. Description of the Related Art

Impact tools (also referred to as impulse or pulse tools) are commonly used in the assembly of large fasteners, such as automotive wheel lug nuts. They are able to deliver large torque forces from a physically compact device and can be operated manually.

As described in U.S. Pat. No. 6,655,471 to Cripe, the disclosure of which is incorporated herein by reference, Impax tools operate by applying sequential pulses of torque to a body, in this case a threaded fastener. If the amplitude of the applied torque is high enough to overcome the static friction force of the fastener, the fastener will turn. If the duration of the pulse is short enough, the average operator can manually operate the device. Unfortunately, there is little correlation between the torque within the fastener body applied by an impact tool and the torque observed by the operator. Therefore, impact tools have not been used where accurate control of a fastener torque is important. Rather, controlled-torque assembly processes have been performed manually by an operator with a torque wrench, or in an automated system with a torque-monitored, (non-impact) motor-driven tool, to fine-tune the torque to a pre-determined value. However, these tools are not practical for assembly of large, high-torque fasteners, such as automotive wheel lug nuts.

The most common method of providing the user with a sense of the torque being applied to a fastener is to equip an impulse tool with a torque meter on the tool output shaft. The torque meter is able to electromechanically observe the torque pulses being delivered to the fastener and can be programmed, through an electronic controller, to automatically shut off the impulse tool when a desired torque is reached. A torque meter can produce electronic voltage signals that may be converted to determine the actual torque being applied to a fastener. Some kind of mathematical function is required, however, to convert torque signals from the torque meter into an electronic signal that the controller can use to provide the mechanical feedback (i.e., an automatic shut off) needed by an operator.

Several methods of performing the torque meter data collection and mathematical signal conversion are disclosed in the related art. In U.S. Pat. No. 6,655,471, Cripe et al. disclose using characteristics of a series of pulses to estimate the actual torque being applied to a fastener. In particular, the patent discloses using a collarless torque transducer sensor and induction coils arranged on and around an impact tool shaft to collect imputed torque signals representing the amplitude and duration of each torque pulse. The amplitude and duration of the torque pulse are subtracted from a torque signal and the resulting difference is integrated over time to obtain a fastener angular velocity signal. The angular velocity signal is integrated over time to obtain a displacement signal which can be converted to a torque signal. The resulting estimated torque value is used to determine whether or not to shut off the impact tool.

U.S. Pat. No. 6,311,786 to Giardino et al. discloses using a collarless torque meter and induction coils to collect imputed torque signals acting over a time duration (i.e., an impulse, which is defined as a series of pulses). Knowing the impulse, the torque arm, and the pulse time duration, an accurate measure of the torque can be derived from a determination of the impulse. The impulse value can also be multiplied by a coefficient of proportionality prior to determination of the torque. The coefficient of proportionality is a predetermined value based on the size of the particular tool, e.g., it may vary based on area of magnetic field and manufacturing tolerance. A disadvantage of this method is that it ignores individual pulses and integrates impulses over time.

U.S. Pat. Nos. 5,366,026 and 5,715,894 to Maruyama et al., disclose controlled impact tools in which direct torque measurements are used. Direct torque measurements are made by measuring the force component of torsional stress on a shaft, as exhibited by a magnetic field about a tool output shaft, at the point in time of impact. Torque is related to the force component times the length of torque arm for a particular pulse. One problem with the methods disclosed in those two patents is that the devices measure torque at a given point in time, which may not accurately represent the true torque because torque measurements fluctuate over time, even after a large number of impacts are applied.

Thus, before the present invention, there was no system or method for dynamically calculating the torque being applied to a fastener by an impact tool using the characteristics of individual pulses over a period of time. There remains, therefore, the need for such a system to better control impact tools and prevent under- or over-tightening and loosening of fasteners or other shafts by impact tools.

SUMMARY OF THE INVENTION

Impact tools use a series of force blows on an anvil attached to a body to tighten or loosen the body. In the case of threaded joint, an impact tool uses a series of short-duration force blows on the side of the head portion at the end of a fastener to turn the threaded shaft portion in the joint. A pulse representing shear stress on the anvil occurs when the impact tool impacts the anvil and kinetic energy is transferred to the joint.

Each pulse of an impact tool will have roughly the same pulse width (i.e., duration) but the torque amplitude will vary slightly over time as shown in FIG. 1. Taken individually, it had been thought, the individual pulses do not provide information as to the torque within the fastener due to the non-linear nature of the impact tool tightening process. Thus, before the present invention, it was difficult to determine the instantaneous torque within a fastener using an impact tool and, thus, the control of impact tools has had limited success in the past. It has now been determined that the stress represented by a single pulse, as shown in FIG. 2, is proportional to the torque on the joint at the time of impact and it has been determined that the stress represented by the pulse is also proportional to the static torque on the joint after the tightening sequence is completed. Thus, each pulse carries important information about the actual torque being applied to a fastener body.

Accordingly, it is a principal object of the present invention to provide a system and method for determining the actual torque applied by an impact tool to a shaft using a set of parameters that show correlation between impact tool pulses and the residual torque without knowing the exact relationship formula.

It is another object of the present invention to provide a system and method for correlating pulses with the residual torque in a fastener body using information about individual pulses.

It is still another object of the present invention to provide a system and method for determining torque by converting the non-linear pulse information into a linear expression of torque using a best-fit method.

It is another object of the present invention to provide a system and method for determining torque by converting the non-linear pulse information into a non-linear simplified expression of torque.

It is still another object of the present invention to provide a system and method for determining torque by using pulse-specific information expressed in millivolts (i.e., amplitude), milliseconds (i.e., duration), millivolt-milliseconds (i.e., area), and numerical counts (i.e., number of pulses, number of fasteners).

It is another object of the present invention to provide a system and method for determining torque that can be easily implemented on an inexpensive embedded controller within an impact tool.

These and other objects and features of the present invention are accomplished as embodied and fully described herein by a method for determining the torque applied to a fastener by applying a torque pulse to a fastener, detecting a signal representing the time-amplitude shape of the torque pulse, fitting an equation that approximates the torque pulse, processing the equation to determine the torque being applied to the fastener, comparing the torque to a pre-set torque objective, and applying a second torque pulse to the fastener if the torque is less than the pre-set torque objective.

The fitted equation includes one or more parameters including, but not limited to, the positive amplitude of the pulses, the negative amplitude, the absolute value of the positive amplitude minus the negative amplitude, the integrated area of the positive portion of the pulse curve, the integrated area of the negative portion of the pulse curve, the duration of the positive portion, the duration of the negative portion, the area from the positive amplitude to 50% of the positive amplitude, the area from the negative amplitude to 50% of the negative amplitude, the duration of the positive portion measured at 50% of the positive amplitude, the duration of the negative portion measured at 50% of the negative amplitude, the time between the start of the positive pulse and the actual pulse peak amplitude, the time between the start of the negative pulse and the actual pulse peak amplitude, and the time between the peaks of the first and second torque pulses. The equation representing the torque pulse may be linear or non-linear.

The objects and features of the present invention are also accomplished by an apparatus for producing a plurality of torque pulses during a tightening sequence of a fastener that includes an impact tool, a shaft connected to the impact tool, a torque transducer coupled to the shaft, a sensor proximate the torque transducer, and a controller. The controller enables the impact tool, applies one or more pulses to the shaft, receives signals from the sensor, monitors and conditions the signals, selects an equation that approximates the signals, processes the equation to obtain the torque on the fastener, and disables the impact tool. In one embodiment of the invention, the impact tool is a pneumatic torque wrench.

Other objects, features and advantages of the present invention will become evident to one skilled in the art from the following detailed description of the invention in conjunction with the referenced drawings.

DETAILED DESCRIPTION OF THE INVENTION

Figure 3:
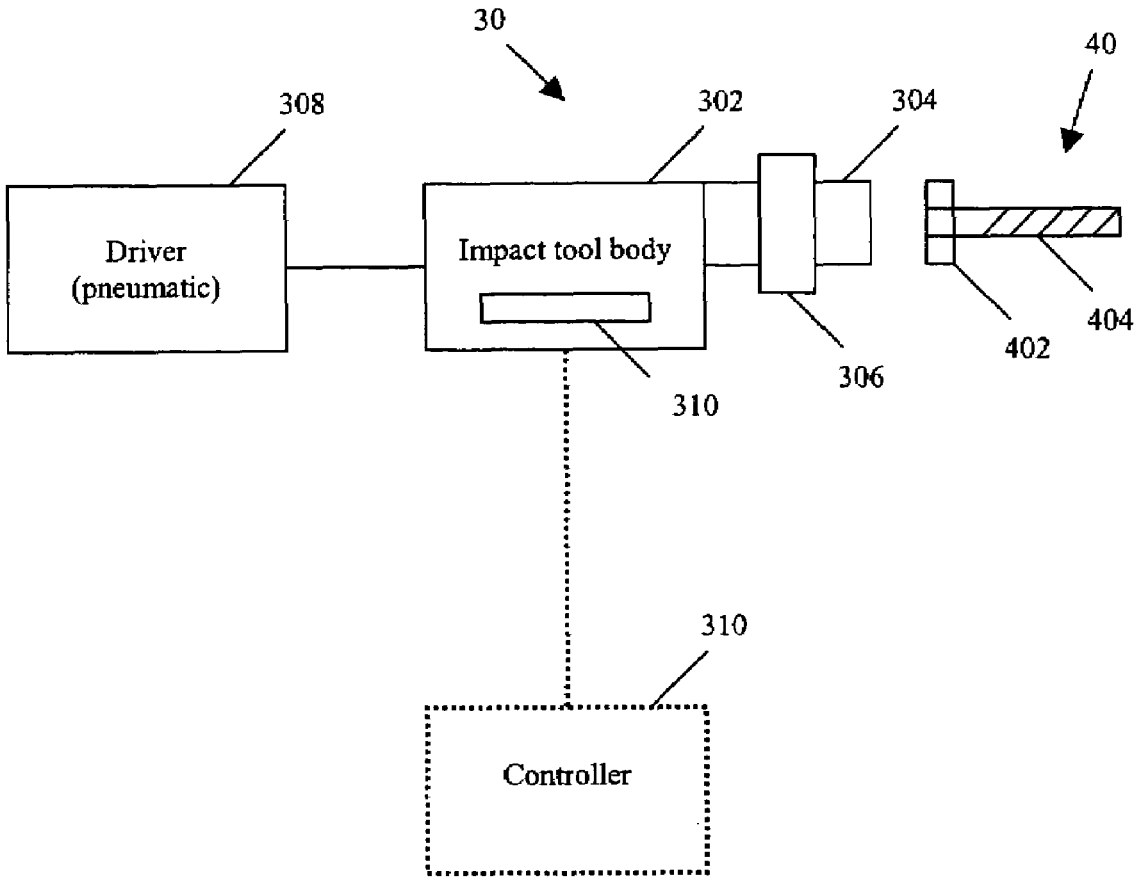
FIG. 3 is a block diagram of an impact tool according to the present invention.

In the present invention, several preferred embodiments are described for illustrative purposes. Turning first to FIG. 3, which is a block diagram of an impact tool of the present invention, there is shown an impact tool 30, which has a body 302 and a shaft 304 connected to the body 302. A torque transducer 306 is located on and surrounds the shaft 304. The torque transducer 306 includes a magnetic field sensor (not shown).

The impact tool 30 is connected to a remote pneumatic driver source 308, such as an air compressor.

The shaft 304 is adapted to be coupled to a fastener 40. The fastener 40 has a head portion 402 and a threaded shaft portion 404. The head portion 402 may be a hexagonal head, for example, which is well known in the art. The shaft 304 may be coupled to the fastener 40 using an anvil or other device (not shown) attached to the end of the shaft 304.

Except as noted below, the system of the present invention is similar to that disclosed in U.S. Pat. No. 6,655,471 to Cripe et al., which is incorporated herein by reference, with respect to the impact tool 30 and a controller 310. The controller 310 of the present invention will include circuits different than those disclosed by Cripe et al.; the circuits are adapted to perform the functions of digitizing and parsing the pulse signals shown in FIGS. 1 and 2 and selecting and executing the appropriate program routines using logic steps required for computing torque values as described above. A 40-MHz processor with a 12-bit A/D converter is preferred for the present embodiment of the invention, although a 20-MHz processor with a 10-bit A/D converter is also useful. The controller 310 may be embodied in a microprocessor-based digital controller programmed in a desired manner located within the impact tool body 302 or it may be an analog electrical component hardwired to the impact tool 30 to accomplish the disclosed functions and may be located external to the impact tool body 302 as shown by the dashed outline of controller 302 in FIG. 3.

In the preferred embodiment of the invention, the torque transducer 306 is a magnetoelastic torque transducer, which produces a magnetic field proximate the output shaft 304 in relation to the amount of torque being applied to the shaft 304. For example the magnetoelastic torque transducers, such as are disclosed in U.S. Pat. No. 6,047,605 to Garshelis, the disclosure of which is incorporated herein by reference, can be used in the preferred embodiment. Shaft 304 can be the output shaft of the impact tool or a shaft extension suitable for retrofiting conventional impact tools with the control system of the invention.

Figure 1:
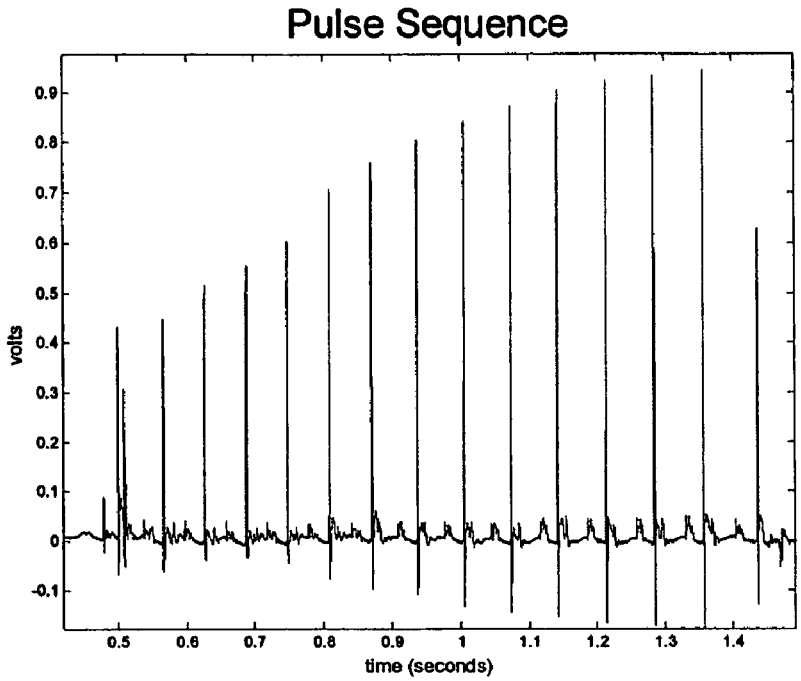
FIG. 1 is a graph of a time-series change in amplitude of a series of pulses produced by an impact tool.
Figure 2:
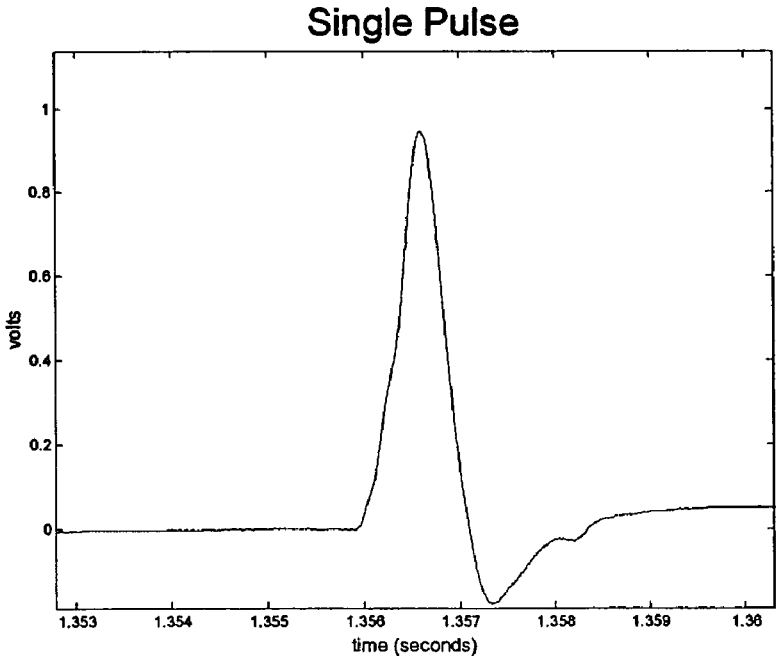
FIG. 2 is a graph depicting the time-series change in amplitude of a single pulse produced by an impact tool.

The output from the torque transducer 306 is a 0 to 5-volt (direct current) (VDC) signal centered at 2.5 VDC (normalized to zero volts as shown in FIGS. 1 and 2). That is, when the impact tool 30 is at rest (no torque) the output signal would nominally be at 2.5 VDC (i.e., zero volts, normalized). When the impact tool 30 is applying a tightening torque to the fastener 40, the signal response would be similar to that shown in FIG. 2, with the primary pulse being above 2.5 VDC and the secondary recoil pulse being less than 2.5 VDC. When the impact tool 30 is applying an un-tightening torque to the fastener 40, the response would be the inverse of FIG. 2, with the primary pulse below 2.5 VDC and the secondary recoil pulse being greater than 2.5 VDC.

In the preferred embodiment of the invention, the controller 310 makes use of three separate printed circuit boards, which are designated as PCB32, PCB50 and PCB51 (not shown). The PCB32 printed circuit board is a general purpose device that performs the general readout functions such as data acquisition, display and communications via a serial port (not shown). The PCB32 also has the ability to execute certain control functions such as activating a solenoid. It can also be expanded to add on other modular printed circuit boards as the application demands.

The PCB50 contains circuits designed to receive the signal input from the magnetic field sensors and to convert the same to a voltage output. This is the first printed circuit board in line to receive the signal directly form the impact tool 30. The output of this is fed into the PCB51 interface card.

The PCB51 contains circuits for processing the impact signals at a high processing speed. This printed circuit board also hosts the torque prediction and decision-making algorithm embedded in the software, as explained below.

Figure 4:
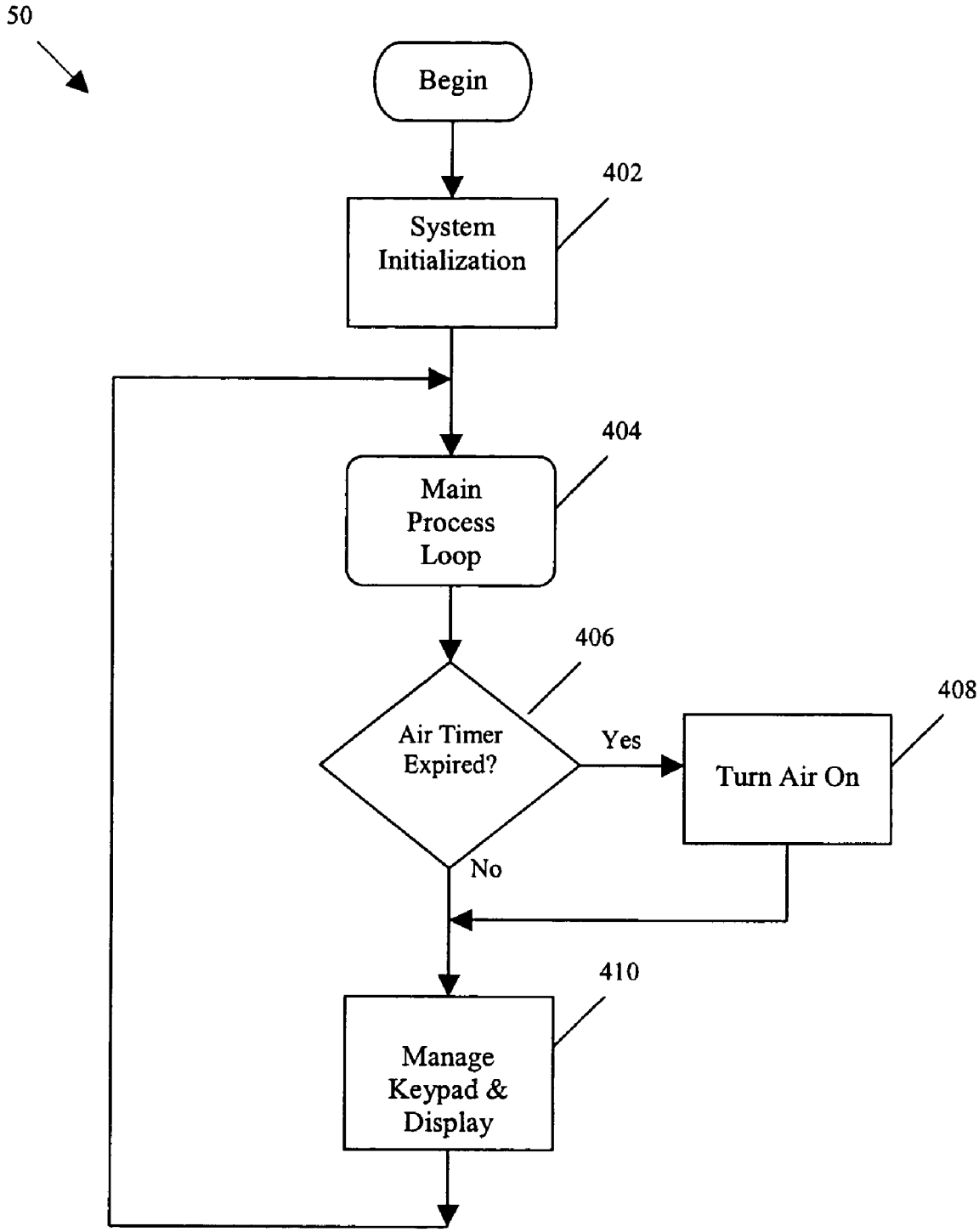
FIG. 4 is a process flow diagram of the preferred embodiment of the invention.

The method of the invention is described by reference to various process flow charts, beginning with FIG. 4, which is a process flow diagram of the preferred embodiment of the present invention. As shown in FIGS. 4 and 5*a* through 5*d*, the method of the invention involves applying a torque pulse to a fastener using, for example, an impact tool. After applying the torque pulse, the system detects a signal representing the time-amplitude waveform of the torque pulse as shown. FIG. 2 illustrates what the waveform could look like. Next, the controller software executes a series of routines fit a linear equation that approximates the torque pulse waveform (or it fits a number of different equations to find the best one). Then the processor solves the equation to determine the torque being applied to the fastener. That torque value is compared to a pre-set torque objective entered by the system operator (or that has been pre-set and coded in the controller software). Finally, a second torque pulse is applied to the fastener if the torque value is less than the pre-set torque objective (or within an acceptable range of the torque objective, such as 10-percent, which may also be entered by the system operator (or pre-set)).

Referring to FIG. 4, there is shown a system initialization process step 402, a main process loop routine 404, process decision step 406, process step 408, and process step 410. The process and decision steps shown in FIG. 4 are embedded in the controller 310 and are programmed to accomplish input/output functions and act as an interface for the user (i.e., the routines scan the keypad, update a display, accept parameter changes, etc.). In addition to servicing the user input/output interface, the steps shown in FIG. 4 are designed to enable and disable the remote pneumatic driver source 308 before and after a tightening event.

Figure 5A:
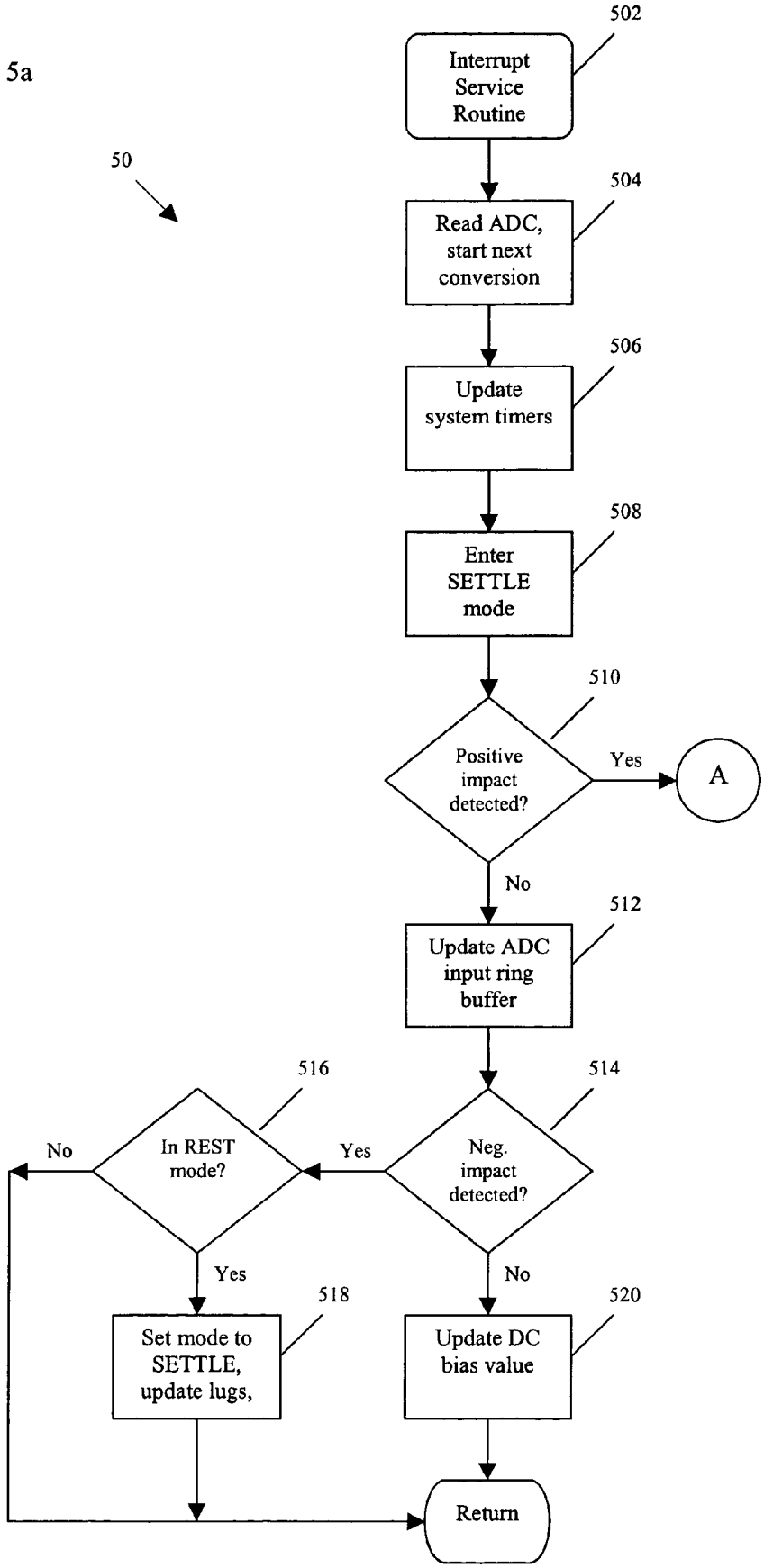
FIG. 5*a* is a continuation of the process flow diagram of FIG. 4.

Turning now to FIG. 5*a*, which is another process flow diagram of the present invention, there is shown an interrupt service routine that executes the conversion equations that determines the torque being applied to the fastener 40. In the preferred embodiment of the invention, the conversion equations are based on the correlation between the sheer stress on the anvil attached to the fastener 40 and the actual torque being applied to the fastener 40. That correlation can be characterized as:

$$y=f(x)$$

Where y is the torque on the fastener 40 joint and x is the stress on the anvil.

The pulses from the torque transducer 306 sensor can be digitized and parsed using electronic circuits and software to separate out a number of parameters that describe the individual pulses shown in FIG. 1. Those parameters may include, but are not limited to, maximum and minimum positive and negative peaks; positive and negative pulse areas; positive and negative pulse widths; positive and negative pulse slopes; absolute value of the positive peak minus the absolute value of the negative peak; pulse areas measured from the positive peak to 50% of the positive peak or from the negative peak to 50% of the negative peak; pulse widths at 50% of the positive or negative peaks; time between the start of the pulse and the actual pulse peak; the time between impacts (i.e., peak timing) measured as the time between successive positive peaks.

Correlation can be shown for a given subset of those parameters, $\phi_0 \ldots \phi_k$, and the fastener 40 torque, which allows the function f(x) to be approximated using simpler functions $\phi_0(x)$, $\phi_1(x)$, . . . $\phi_k(x)$. Where the functions are added together, f(x) becomes a linear expression:

$$y=f(x)=\beta_0\phi_0(x)+\beta_1\phi_1(x)+\beta_2\phi_2(x)+\ldots\beta_k\phi_k(x)$$

Where $\beta_0 \ldots \beta_k$, are correlation coefficients. The method of least squares can then be used to determine the coefficients, $\beta_0 \ldots \beta_k$, for the linear expression.

In more simplified terms, the above can be expressed as follows:

$$y=f(x)=[(\beta_0\cdot\text{positive peak})+(\beta_1\cdot\text{negative peak})+(\beta_2\cdot\text{positive pulse area})+\ldots]/f$$

Where f is a scaling factor.

To calculate the coefficients, $\beta_0 \ldots \beta_k$, a number of data samples are gathered that relate a set of given parameters to a known torque on a fastener 40. The number of samples, n, must be larger than the number of coefficients used, k. The parameters for the samples are then organized in a matrix A and vector, Y, where s represents a given sample run:

$$A=\begin{pmatrix} S_0\varphi_0 & S_0\varphi_1 & S_0\varphi_2 & \ldots & S_0\varphi_k \\ S_1\varphi_0 & S_1\varphi_1 & S_1\varphi_2 & \ldots & S_1\varphi_k \\ S_2\varphi_0 & S_2\varphi_1 & S_2\varphi_2 & \ldots & S_2\varphi_k \\ \ldots & & & & \\ S_n\varphi_0 & S_n\varphi_1 & S_n\varphi_2 & \ldots & S_n\varphi_k \end{pmatrix} \quad Y=\begin{pmatrix} y_0 \\ y_1 \\ y_2 \\ \ldots \\ y_n \end{pmatrix} \quad B=\begin{pmatrix} \beta_0 \\ \beta_1 \\ \beta_2 \\ \ldots \\ \beta_n \end{pmatrix}$$

The matrix equation, AB=Y+E describes the relationship. The vector E is the error associated with each calculation, measured in units of torque. To calculated the coefficients, the sum of the squares of the derivations is defined as:

$$S = \sum_{i=1}^{n} [y_i - \beta_0\varphi_0(x_i) - \beta_1\varphi_1(x_i) - \ldots \ \beta_k\varphi_k(x_i)]^2$$

The coefficients, β, may be determined in such a way as S assumes a minimum. One way of accomplishing this is to denote the sums:

$$\sum_{i=1}^{n} \varphi_j(x_i)\varphi_k(x_i) \text{ and } \sum_{i=1}^{n} y(x_i)\varphi_k(x_i)$$

From these expression, a matrix equation may be obtained:

$$\begin{pmatrix} \varphi_0^2 & \varphi_0\varphi_1 & \varphi_0\varphi_2 & \cdots & \varphi_0\varphi_k \\ \varphi_1\varphi_0 & \varphi_1^2 & \varphi_1\varphi_2 & \cdots & \varphi_1\varphi_k \\ \varphi_2\varphi_0 & \varphi_2\varphi_1 & \varphi_2^2 & \cdots & \varphi_0\varphi_k \\ \cdots & & & & \cdots \\ \varphi_k\varphi_0 & \varphi_k\varphi_1 & \varphi_k\varphi_2 & \cdots & \varphi_k^2 \end{pmatrix} \begin{pmatrix} \beta_0 \\ \beta_1 \\ \beta_2 \\ \\ \beta_k \end{pmatrix} = \begin{pmatrix} y\varphi_0 \\ y\varphi_1 \\ y\varphi_2 \\ \cdots \\ y\varphi_k \end{pmatrix}$$

Using matrix inversion and multiplication a set of best fit β's may be calculated. The accuracy of the coefficients with respect to a given sample can be calculated by applying the coefficients to the sample matrix and comparing the results with the recorded torque readings.

Although the above technique of converting the pulse curves into linear expressions is expedient in terms of simplifying the computations and decreasing the time required to execute the computations, which is an important consideration in selecting a processor speed and coding the programming routines, other expressions, both linear and non-linear, are also contemplated by the present invention. That is because each impact tool may create slightly different pulses that may need to be correlated to the actual torque using different mathematical expressions. The present invention contemplates utilizing the artificial intelligence technique known as an expert system, which is designed to simulate the thought processes and the procedure that might be followed by an expert in determining which expression and set of parameters to be used, based upon the best available data, to determine the torque values. Another method contemplated by the invention is to simply code multiple routines covering several different linear and non-linear expressions that can handle the digitized and parsed pulse data and that execute sequentially by the controller 310 until a desired mathematical expression of the pulses is found to determine the torque values.

Turning again to FIG. 5*a*, the interrupt service routine 502 continuously scans the torque transducer 306 sensor A/D converter (not shown) in step 504. It should be understood that the interrupt routine 502 has priority over the input/output process and decision steps shown in FIG. 4. Once a signal is detected, process step 506 executes and updates the system timers. Then, the program enters the first of three primary modes in process step 508, which is the SETTLE mode. The SETTLE mode is programmed to execute for about 20 msec.

The SETTLE mode is entered immediately after the tail of an impact is detected or when an un-tightening (reverse) impact is detected. In this mode, a value for the variable DCBIAS is not calculated because the sensor input has not settled yet. The variable DCBIAS is set to a computed value that establishes the zero torque (zero voltage) reference. This is used to compensate for drift or offset of the sensor zero torque output which, in theory, is zero volts but, in practice, may not be zero.

In decision step 510, the algorithm branches to a separate routine labeled "A" or continues to process step 512, in which the A/D converter input ring buffer is updated. In decision step 514, either the DCBIAS value is computed and the interrupt service routine 502 is returned to the main process loop 404 (FIG. 4), or the program enters the SETTLE modes in process step 518 after checking to see if the program is in the second of the three primary modes: REST mode.

The REST mode of the system is the default mode. In this mode the interrupt service routing 502 is run at about 15 KHz. The torque transducer 306 sensor is scanned, if an impact is not detected the interrupt service routine 502 does some timer house keeping and updates the DCBIAS value.

Figure 5B:
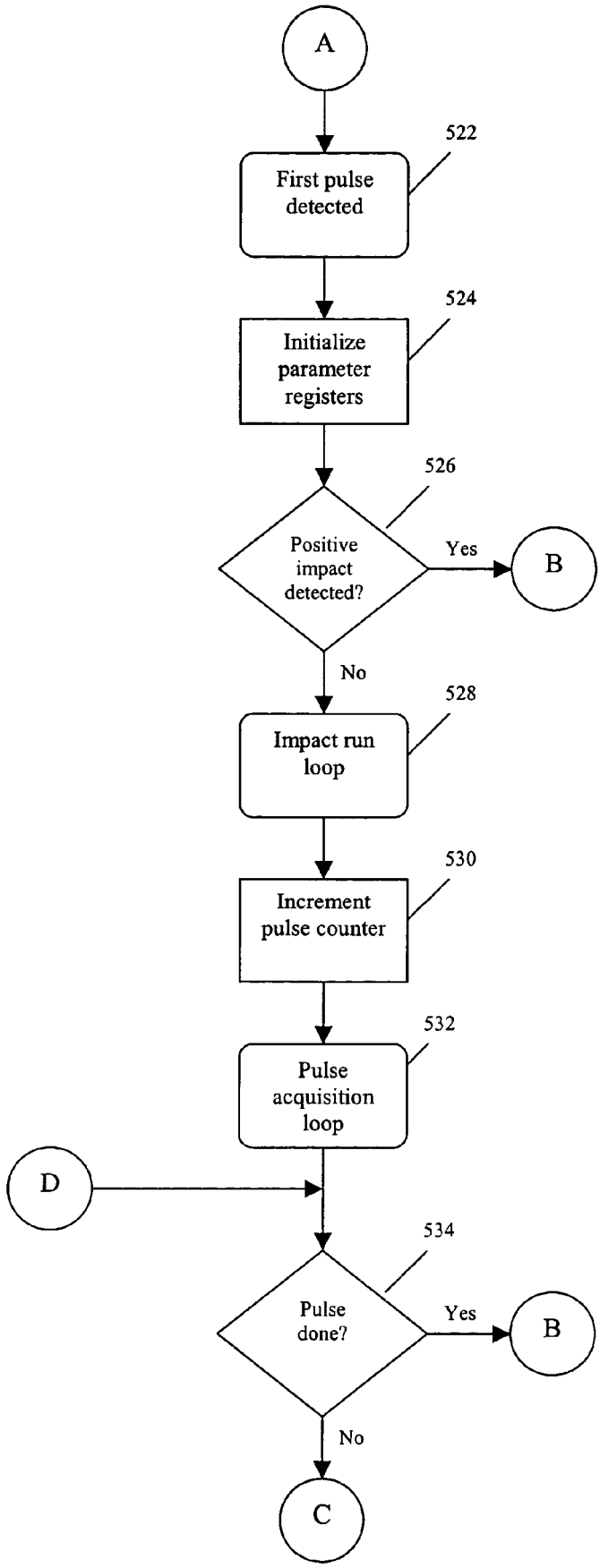
FIG. 5*b* is a continuation of the process flow diagram of FIG. 5*a;*

Turning now to FIG. 5*b*, which is a continuation of the process flow diagram of FIG. 5*a*, the program routine labeled "A" in FIG. 5*a* is shown. This routine is the third of the three primary modes of the system: IMPACT mode. This mode is entered when a tightening impact is detected in step 522. In process step 524, the parameter registers (e.g., pulse counter) are initialized. In decision step 526, the program branches to a separate routine labeled "B" or continues and executes the impact run loop step 528 by first incrementing the pulse counter in step 530. The impact run loop 528 has two sub-modes: ACQUISITION loop 532 and WAIT loop (described below; see FIG. 5*d*).

Figure 5C:
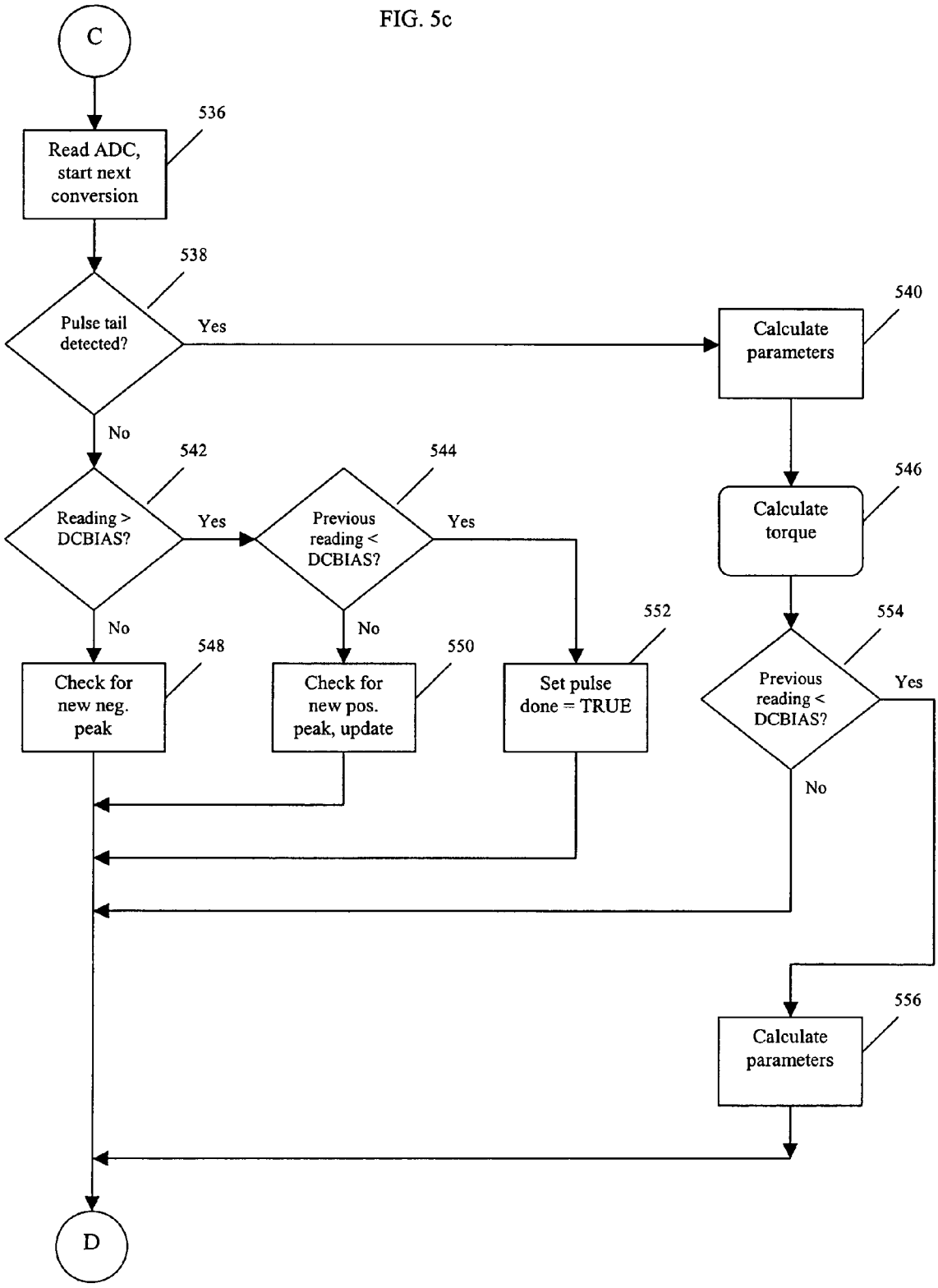
FIG. 5*c* is a continuation of the process flow diagram of FIG. 5*b*.

Turning now to FIG. 5*c*, which is a continuation of the process flow diagram of FIG. 5*b*, the program routine labeled "C" in FIG. 5*b* is shown. When the controller 310 enters the IMPACT mode, it does not exit the interrupt service routine 502 until the impact tool 30 stops producing pulses (or a maximum number of pulses is detected by way of a pulse counter variable). In process step 536, it scans the torque transducer 306 sensor at about 40 kHz (depending on the speed of the microprocessor associated with the controller 310).

The controller 310 stops scanning the torque transducer 306 sensor when, in decision step 538, it detects the tail of the impact (i.e., the signal crosses from a negative voltage signal to a positive voltage signal, taking into account the computed DCBIAS voltage values in decision and process steps 542, 544, 548, 550 and 552). Then, the controller 310 runs the torque prediction equations in process step 540 and calculates torque values in step 546. If the calculated torque value matches the inputed target torque value within an acceptable range (say, 10%), the controller 310 disengages the remote pneumatic driver source 308 (FIG. 3) and the tightening/un-tightening sequence ends.

Figure 5D:
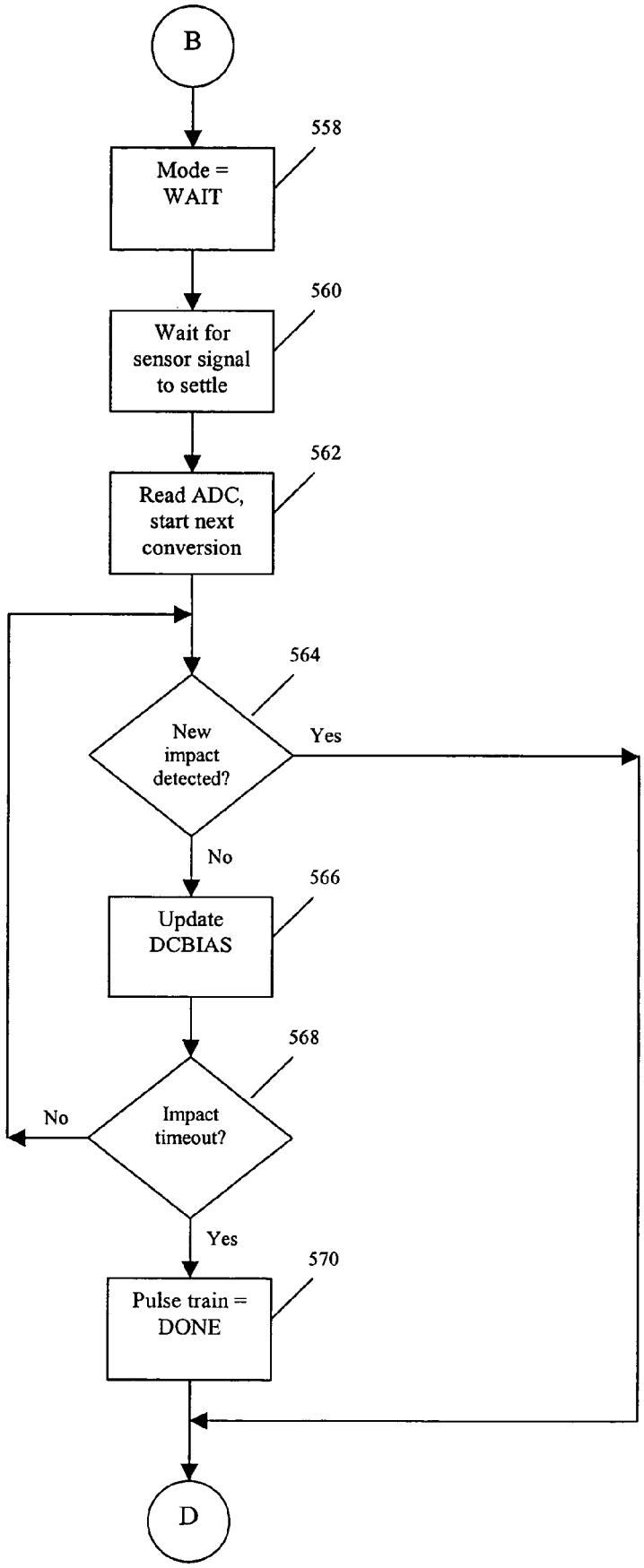
FIG. 5*d* is a continuation of the process flow diagram of FIG. 5*c*.

Turning now to FIG. 5*d*, which is a continuation of the process flow diagram of FIGS. 5*a*, 5*b* and 5*c*, the program routine labeled "B" in FIG. 5*b* is shown. This routine is the WAIT mode. In this mode, the controller 310 waits for the next impact pulse. In general, the time between impacts is approximately 50 msec, depending on the impact tool 30. The conversion calculations take about 5 msec, depending on how many mathematical expressions subset of parameters are used to estimate the torque value. The controller 310 waits another about 20 msec before scanning the torque transducer 306 sensor to allow the sensor to settle down. During this time, the controller 310 is in a tight scanning loop at about 40 kHz (again, depending on the clock speed of the microprocessor) attempting to detect the next pulse in process steps 560 and 562. If the pulse is not detected in query step 564, the DCBIAS value is recalculated in process step 566. If the pulse is detected in query step 564, the controller 310 enters the ACQUISITION loop 532 again and starts all over. If no pulse is detected in a pre-set period of about 200 msec in query step 568, then the controller 310 times out in process step 570 and the run would be considered over. The controller 310 would then enter the REST mode and the interrupt service routine 502 would exit. Once the interrupt service routine 502 exits, the user input/output service routine shown in FIG. 4 can run again and the calculated torque is displayed on a display screen (not shown).

One of the counters initialized in process step 524 (FIG. 5*b*) is a counter that keeps track of how many un-tightening sequences have occurred. This is used in wheel changing applications to ensure that all of the lug nuts are re-installed. When the wheel is put back on a car, the controller 310 compares the number of tightening sequences to the number of un-tightening sequences. If they are not the same, the display indicates an error message.

Although this invention has been described in connection with specific embodiments, objects and purposes for the invention, it will be appreciated by one of skill in the art that various modifications of the invention, other than those discussed above, may be resorted to without departing from the nature and scope of the invention.

What is claimed is:

1. A method for determining the torque applied to a fastener comprising the steps of:
   - applying a torque pulse to a fastener;
   - detecting a signal representing the time-amplitude waveform of the torque pulse;
   - fitting an equation that approximates the time-amplitude waveform by selecting one mathematical expression from a set of mathematical expressions and selecting at least one parameter that describes the torque pulse from a set of parameters;
   - processing the equation to determine the torque being applied to the fastener;
   - comparing the torque to a pre-set torque objective; and
   - applying a second torque pulse to the fastener if the torque is less than the pre-set torque objective.

2. The method of claim 1, wherein the equation includes at least one parameter selected from the group consisting of the positive amplitude; negative amplitude; absolute value of the positive amplitude minus the negative amplitude; integrated area of the positive portion of the pulse curve; integrated area of the negative portion of the pulse curve; duration of the positive portion; duration of the negative portion; area from the positive amplitude to 50% of the positive amplitude; area from the negative amplitude to 50% of the negative amplitude; duration of the positive portion measured at 50% of the positive amplitude; duration of the negative portion measured at 50% of the negative amplitude; time between the start of the positive pulse and the actual pulse peak amplitude; time between the start of the negative pulse and the actual pulse peak amplitude; and time between the peaks of the first and second torque pulses.

3. The method of claim 1, wherein the equation for the torque pulse is linear.

4. The method of claim 3, wherein the linear equation is represented by the formula:

$$\text{torque}=f(t)=\beta_0\phi_0(t)+\beta_1\phi_1(t)+\beta_2\phi_2(t)+\beta_3\phi_3(t),$$

wherein t is a time scale, and wherein $\beta_0 \ldots \beta_3$, are correlation coefficients and are determined using the method of least squares after collecting data from sample runs, and wherein $\phi_0(t)$ represents the highest positive peak amplitude of the torque pulse, $\phi_1(t)$ represents the negative peak amplitude of the torque pulse, $\phi_2(t)$ represents the positive area of the torque pulse and $\phi_3(t)$ represents the positive width of the torque pulse.

5. The method of claim 4, wherein the correlation coefficients are determined by minimizing the function, S:

$$S=\sum_{i=1}^{n}[y_i-\beta_0\phi_0(x_i)-\beta_1\phi_1(x_i)-B_2\phi_2(x)-\beta_3\phi_3(x_i)]^2.$$

6. The method of claim 1, wherein the equation for the torque pulse is non-linear.

7. The method of claim 1, wherein the step of fitting an equation representing the torque pulse includes selecting at least two parameters that describe the torque pulse from the set of parameters.

8. The method of claim 1, wherein the signal is produced by a magnetoelastic torque transducer associated with a shaft and an induction coils proximate the shaft.

9. The method of claim 1, wherein an impact tool is used to apply the torque pulse to the fastener.

10. The method of claim 1, wherein the impact tool is a pneumatic-driven torque wrench.

11. A method for determining the torque applied to a fastener comprising the steps of:
   - applying a plurality of torque pulses to a fastener during a fastener tightening sequence, wherein the torque pulses have a duration and amplitude;
   - detecting a signal representing the time-amplitude waveform shapes of each of the torque pulses;
   - converting the signals into mathematical expressions representing each of the torque pulses, wherein each mathematical expressions is selected from a set of mathematical expressions and include parameters representing at least the amplitude and duration of the torque pulses;
   - processing the mathematical expressions to obtain the torque applied to the fastener during the torque pulses; and
   - terminating the fastener tightening sequence if the torque is approximately equal to a pre-set torque objective.

12. The method of claim 11, wherein the mathematical expressions also include at least one additional parameter selected from the group consisting of the maximum positive amplitude; maximum negative amplitude; absolute value of the positive amplitude minus the negative amplitude, integrated area of the positive portion of the pulse curve; integrated area of the negative portion of the pulse curve; duration of the positive portion; duration of the negative portion; area from the positive amplitude to 50% of the positive amplitude; area from the negative amplitude to 50% of the negative amplitude; duration of the positive portion measured at 50% of the positive amplitude; duration of the negative portion measured at 50% of the negative amplitude; time between the start of the positive pulse and the actual pulse peak amplitude; time between the start of the negative pulse and the actual pulse peak amplitude; and time between successive positive peak amplitudes.

13. The method of claim 11, wherein the mathematical expressions for the torque pulses are linear expressions.

14. The method of claim 13, wherein the linear mathematical expressions are represented by the formula:

$$\text{torque}=f(t)=\beta_0\phi_0(t)+\beta_1\phi_1(t)+\beta_2\phi_2(t)+\beta_3\phi_3(t),$$

wherein t is a time scale, and wherein $\beta_0 \ldots \beta_3$, are correlation coefficients and are determined using the method of least squares after collecting data from sample runs, and wherein $\phi_0(t)$ represents the highest positive peak amplitude of the torque pulses, $\phi_1(t)$ represents the negative peak amplitude of the torque pulses, $\phi_2(t)$ represents the positive area of the torque pulses and $\phi_3(t)$ represents the positive width of the torque pulses.

15. The method of claim 14, wherein the correlation coefficients are determined by minimizing the function, S:

$$S = \sum_{i=1}^{n} [y_i - \beta_0\phi_0(x_i) - \beta_1\phi_1(x_i) - B_2\phi_2(x) - \beta_3\phi_3(x_i)]^2.$$

16. The method of claim 11, wherein the mathematical expressions for the torque pulses are non-linear.

17. The method of claim 11, wherein the step of converting the signals into mathematical expressions representing the torque pulses is accomplished by selecting one mathematical expression from a set of mathematical expressions and selecting at least two parameters that describe the torque pulses from a set of parameters.

18. The method of claim 11, wherein the signal is produced by a magnetoelastic torque transducer associated with a shaft and an induction coils proximate the shaft.

19. The method of claim 11, wherein an impact tool is used to apply the plurality of torque pulses to the fastener.

20. The method of claim 11, wherein the impact tool is a pneumatic-driven torque wrench.

21. An apparatus for producing a plurality of torque pulses during a tightening sequence of a fastener comprising:

an impact tool;

a shaft operatively connected to the impact tool;

a torque transducer coupled to the shaft;

a sensor proximate the torque transducer; and a controller, wherein the controller enables the impact tool, applies one or more pulses to the shaft, receives waveform signals from the sensor, monitors and conditions the signals; selects an equation that approximates the signals by selecting a mathematical expression from a set of mathematical expressions and selecting at least one parameter that describes the torque pulse from a set of parameters; processes the equation to obtain the torque on the fastener; and disables the impact tool, and wherein the equation represents the time-amplitude curve of the one or more pulses and includes parameters for the amplitude, duration and the area under the time-amplitude curve.

22. The apparatus of claim 21, wherein the impact tool is a pneumatic torque wrench.

23. The apparatus of claim 21, wherein the equation is linear.

24. The apparatus of claim 23, wherein the linear equation is represented by the formula:

$$\text{torque}=f(t)=\beta_0\phi_0(t)+\beta_1\phi_1(t)+\beta_2\phi_2(t)+\beta_3\phi_3(t),$$

wherein t is a time scale, and wherein $\beta_0 \ldots \beta_3$, are correlation coefficients and are determined using the method of least squares after collecting data from sample runs, and wherein $\phi_0(t)$ represents the highest positive peak amplitude of the torque pulse, $\phi_1(t)$ represents the negative peak amplitude of the torque pulse, $\phi_2(t)$ represents the positive area of the torque pulse and $\phi_3(t)$ represents the positive width of the torque pulse.

25. The apparatus of claim 24, wherein the correlation coefficients are determined by minimizing the function, S:

$$S = \sum_{i=1}^{n} [y_i - \beta_0\phi_0(x_i) - \beta_1\phi_1(x_i) - B_2\phi_2(x) - \beta_3\phi_3(x_i)]^2.$$

26. The apparatus of claim 21, wherein the equation is non-linear.

* * * * *